United States Patent [19]

Aoyama

[11] 4,218,995

[45] Aug. 26, 1980

[54] HYDRAULIC VALVE LIFTER MECHANISM FOR INTERNAL COMBUSTION ENGINE

[75] Inventor: Syunichi Aoyama, Yokohama, Japan

[73] Assignee: Nissan Motor Company, Limited, Yokohama, Japan

[21] Appl. No.: 944,137

[22] Filed: Sep. 20, 1978

[30] Foreign Application Priority Data

Sep. 21, 1977 [JP] Japan ..... 52-113537

[51] Int. Cl.[2] ..... F01L 1/34; F01L 1/24

[52] U.S. Cl. ..... 123/90.55; 123/90.16; 123/90.57

[58] Field of Search ..... 123/90.12, 90.15, 90.16, 123/90.48, 90.52, 90.55, 90.56, 90.57, 90.58, 90.59

[56] References Cited

U.S. PATENT DOCUMENTS

| | | | |
|---|---|---|---|
| 2,393,793 | 1/1946 | Meth | 123/90.57 |
| 2,484,109 | 10/1949 | Meinecke | 123/90.16 |
| 3,385,274 | 5/1968 | Shunta et al. | 123/90.55 |
| 3,439,661 | 4/1969 | Weiler | 123/90.16 |
| 3,490,423 | 1/1970 | Shunta et al. | 123/90.55 |
| 3,518,976 | 7/1970 | Thuesen | 123/90.16 |
| 3,742,921 | 7/1973 | Rendine | 123/90.16 |
| 3,817,228 | 6/1974 | Bywater | 123/90.16 |
| 4,020,806 | 5/1977 | Aoyama et al. | 123/90.56 |
| 4,153,016 | 5/1979 | Hausknecht | 123/90.16 |

FOREIGN PATENT DOCUMENTS

| | | | |
|---|---|---|---|
| 179119 | 4/1966 | U.S.S.R. | 123/90.16 |

*Primary Examiner*—Ronald H. Lazarus

*Attorney, Agent, or Firm*—Schwartz, Jeffery, Schwaab, Mack, Blumenthal & Koch

[57] ABSTRACT

A hollow cylinder is slidably received in a bore formed through an engine block with its closed end in contact with a lobed cam mounted on a camshaft, and a piston connected to a push rod is received in an end portion of the bore. A plunger disposed in the bore partly intrudes into the cylinder so as to define a first oil pressure chamber in the cylinder and a second oil pressure chamber between the plunger and the piston. When oil pressure applied to the first chamber is decreased as the engine speed lowers, the plunger moves toward the first chamber to allow the second chamber to communicate with an oil-reserving chamber through a hole. The amount of valve lift in a medium oil pressure range depends on the degree of closing of this hole by the plunger which is moved together with the cylinder by the rotating cam.

11 Claims, 5 Drawing Figures

HYDRAULIC VALVE LIFTER MECHANISM FOR INTERNAL COMBUSTION ENGINE

BACKGROUND OF THE INVENTION

This invention relates to a hydraulic valve lifter mechanism which constitutes part of a valve train of an internal combustion engine, particularly, on an automobile.

Traditionally, intake and exhaust valves of an internal combustion engine, particularly an automotive engine, are made to open and close each with a fixed amount of valve lift determined by giving priority to the maximum output of the engine. However, the amount of valve lift thus determined is too large to maintain a desirable valve overlap period at low engine speeds or during idling. An excessively large valve overlap under such conditions tends to cause unfavorable phenomena such as less efficient combustion by reason of backward flow of the combustion gas.

To solve this problem, it has been proposed to include in the valve train a hydraulic valve lifter or tappet which has the function of varying the valve opening and closing timing and the amount of valve lift depending on the pressure of engine lubricating oil as an indication of the engine speed. A typical example of such hydraulic valve lifters is disclosed in U.S. Pat. No. 4,020,806 to Aoyama et al. This valve lifter has a cylindrical body slidably received in a bore formed in an engine block such that a closed end of the cylinder keeps in contact with a cam mounted on the camshaft. A plunger connected to a push rod is slidably received in the body to define an oil pressure chamber in the body, and a free piston is disposed in this chamber under the force of a compression spring such that the volume of the oil pressure chamber varies depending on the oil pressure applied to this chamber. When the body is lifted by the cam lobe while oil pressure applied to the oil pressure chamber is below a certain level, the movement of the body relative to the plunger causes an abrupt increase in the oil pressure in the chamber and hence an abrupt movement of the free piston to increase the volume of the chamber. As the result, the plunger moves towards the closed end of the body whereby the action of the valve begins at retarded timing and the amount of valve lift is decreased.

However, it becomes a disadvantage of this valve lifter that under low engine speed conditions the linkage including the valve and the push rod is forced to begin its action abruptly against the inertia of the respective components since a great impulsive force is exerted on each component at the start of its action and, as a consequence, the action of the linkage produces a loud noise. Besides, the impulsive manner of actuation of the linkage is unfavorable to the durability of the respective components.

SUMMARY OF THE INVENTION

Concerning a valve train for an internal combustion engine, it is an object of the present invention to provide a hydraulic valve lifter mechanism to vary the valve action timing and the amount of valve lift depending on the engine operating condition, which lifter mechanism functions without causing impulsive and significantly noisy valve action.

A hydraulic valve lifter mechanism according to the invention serves as a component of a valve train for an internal combustion engine having a lobed cam on a camshaft and a push rod linked with a valve to be intermittently opened according to the rotation of the lobed cam. The valve lifter mechanism comprises a hollow cylindrical body which has an open end and a closed end and is slidably received in a bore formed in an engine block such that the closed end of the body keeps sliding contact with the cam, a piston connected to the push rod and slidably received in an end portion of the bore, and a plunger which is slidably received in the bore and in an end portion thereof slidably intrudes into the cylindrical body so as to define a first oil pressure chamber in a closed end portion of the body and a second oil pressure chamber in the bore between the piston and the plunger. The lifter mechanism includes means for applying an oil pressure, which is variable depending on the operating condition of the engine, to the first oil pressure chamber and an oil-reserving chamber formed in the engine block so as to communicate with the second oil pressure chamber through a hole which opens to the second oil pressure chamber when the aforementioned oil pressure is relatively low so that the second oil pressure chamber has a relatively large volume but is closed by the plunger when the oil pressure is relatively high so that the plunger is moved relative to the body toward the piston. The amount of lift of the valve depends on oil pressure applied to the first oil pressure chamber, and in a medium range of the oil pressure the amount of the valve lift depends on a resistance offered by the hole in a partly closed state to the outflow of the oil from the second oil pressure chamber into the oil-reserving chamber while the body and the plunger are moved towards the piston by the rotating cam.

Preferably, engine lubricating oil is supplied to the first oil pressure chamber such that the oil pressure applied to this chamber decreases, with the result that the amount of valve lift decreases, as the engine speed lowers.

A preferred example of the oil-reserving chamber is a variable-volume chamber defined in a cylindrical bore in which a free piston is slidably received such that an increasing tendency of the oil pressure in the second oil pressure upon movement of the plunger towards the piston is absorbed by the movement of this free piston until the hole connecting the oil-reserving chamber with the second oil pressure chamber is completely closed by the moved plunger.

DESCRIPTION OF THE PREFERRED EMBODIMENTS

Figure 1:
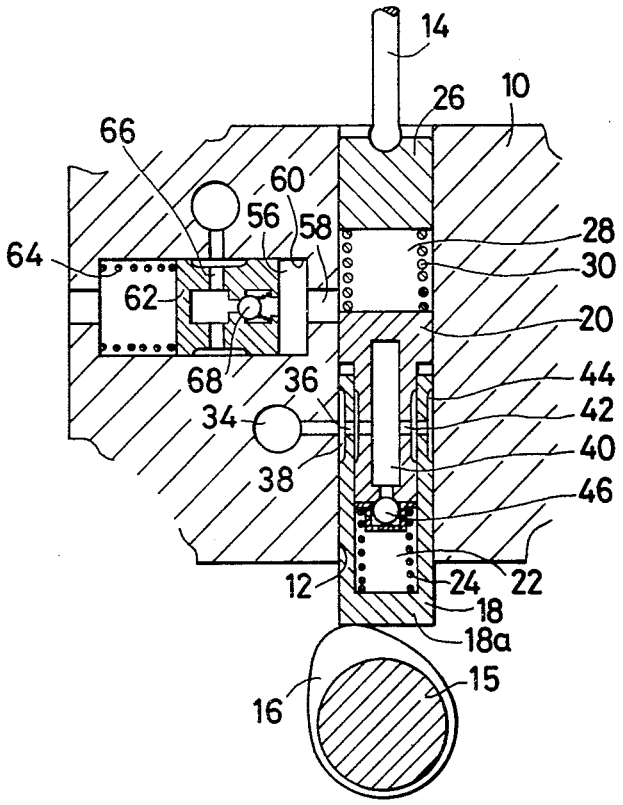
FIG. 1 is a longitudinal sectional view of a preferred embodiment of a valve lifter mechanism according to the invention.

Referring to FIG. 1, a valve lifter mechanism according to the invention intervenes between a cam 16 fixedly mounted on a camshaft 15 driven by the crankshaft (not shown) of the engine and a push rod 14 linked with an intake or exhaust valve (not shown) to serve the function of a tappet. A cylindrical bore 12 is formed through an engine block 10 so as to be in axial alignment with the push rod 14. The longitudinal axis of the bore 12 is perpendicular to the camshaft 15. A hollow cylindrical body 18 having an open end and a closed end, i.e. end wall 18*a*, is slidably received in the bore 12. The end wall 18*a* of this cylinder 18 keeps in contact with the cam 16 such that the cylinder 18 acts as a cam follower. The open end of the cylinder 18 always remains in the bore 12 irrespective of the angular position of the cam 16. A compression spring 24 is disposed in the cylinder 18, and a cylindrical plunger 20 is slidably inserted into the cylinder 18 so as to define a variable-volume chamber 22 in the cylinder 18 between the end wall 18*a* and the inserted end of the plunger 20. The plunger 20 is enlarged in an end portion remaining out of the cylinder 18 so as to establish sliding engagement with the bore 12. A piston 26 connected to the free end of the push rod 14 is slidably received in an end portion of the bore 12. The lengths of the plunger 20 and the piston 26 are such that a variable-volume chamber 28 is defined in the bore 12 between the plunger 20 and the piston 26, and a compression spring 30 is installed in this chamber 28 (will be called the second chamber). The force of this compression spring 30 is greater than the force of the compression spring 24 in the aforementioned chamber 22 (will be called the first chamber), so that the plunger 20 is biased toward the first chamber 22.

An oil passage 34 communicating with an oil pump (not shown), which delivers lubricating oil during operation of the engine, opens into the bore 12 at a section always occupied by the cylinder 18 and the plunger 20. The cylinder 18 is formed with radial apertures 36 through its side wall and a circumferential groove on the outside of the side wall arranged such that the apertures 36 always communicate with the oil passage 34 irrespective of the movement of the cylinder 18 by the rotation of the cam 16. The plunger 20 has an axial bore 40, which opens into the first chamber 22 but is partitioned from the second chamber 28, and radial apertures 42 opening into the bore 40. A circumferential groove 44 formed on the outside of the side wall of the plunger 20 ensures communication of the apertures 42 in the plunger 20 with the apertures 36 in the cylinder 18 even though the plunger 20 changes its position relative to the cylinder 18. Thus the first chamber 22 in the cylinder 18 communicates with the oil passage 34 through the bore 42, apertures 42, 36 and grooves 44, 38, so that the engine lubricating oil enters the chamber 22 during operation of the engine and the pressure of the oil acts on the plunger 20. To prevent the oil from being forced out of the chamber 22 when the end wall 18*a* of the cylinder 18 is moved towards the plunger 20 by the rotating cam 16, the plunger 20 is provided with a check valve 46 at the opening of the axial bore 40 into the chamber 22.

Figure 2:
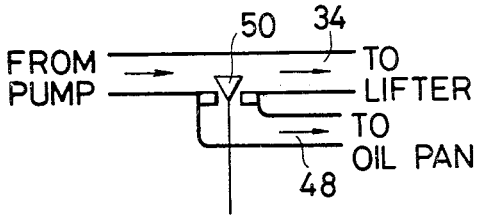
FIG. 2 shows diagrammatically an example of oil-pressure control means for the mechanism of FIG. 1.

The oil passage 34 is provided with a valve means for controlling oil pressure applied to the first chamber 22 according to the operating condition of the engine. Referring to FIG. 2, a return passage 48 which extends to an oil pan (not shown) branches from the oil passage 34 with the provision of a valve 50 to control an effective cross-sectional area of this return passage 48. The valve 50 is linked with either a throttle valve (not shown) or an accelerator pedal (not shown) for the engine such that the effective cross-sectional area of the return passage 48 is decreased thereby to augment oil pressure applied to the first chamber 22 as the degree of opening of the throttle valve is enlarged, or as the accelerator pedal is worked for the same effect. This means that an increasing oil pressure is applied to the first chamber 22 as the engine speed becomes higher.

Figure 3:
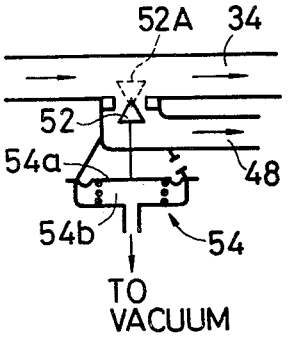
FIG. 3 shows diagrammatically another example of such oil-pressure control means.

FIG. 3 shows another method of controlling an effective cross-sectional area of the oil return passage 48. In this case a valve 52 to vary the effective cross-sectional area is combined with a vacuum-operated valve actuator 54, in which a flexible diaphragm 54*a* serves as a wall of a vacuum chamber 54*b* and supports the valve 52. The vacuum chamber 54*b* communicates with the induction passage for the engine at a venturi section upstream of the throttle valve, and the valve 52 is arranged such that the effective cross-sectional area of the return passage 48 decreases as the magnitude of vacuum in the venturi section increases. Alternatively, the vacuum chamber 54*b* may be connected to the induction passage at a section downstream of the throttle valve, for example to the intake manifold. In this case a valve 52A supported by the diaphragm 54*a* is so arranged as to decrease the effective cross-sectional area of the return passage 48 as the magnitude of intake vacuum decreases.

An oil-reserving chamber 56 is formed in the engine block 10, and a hole 58 provides communication between this chamber 56 and the second chamber 28 in the bore 12. The hole 58 has such a cross-sectional area and joins the bore 12 at such a location that the hole 58 is open to the second chamber 28 while the plunger 20 remains far distant from the piston 26 but is closed by the plunger 20 when the distance between the plunger 20 and the piston 26 shortens to a certain extent as will be explained hereinafter. Thus the second chamber 28 is filled with pressure oil, and the first and second chambers 22 and 28 serve as oil pressure chambers, respectively.

The oil-reserving chamber 56 and the hole 58 serve the function of maintaining a nearly constant oil pressure in the second oil pressure chamber 28 so long as the hole 58 is fully open to the chamber 28. Since the spring 30 biases the plunger 20 towards the first oil pressure chamber 22, the hole 58 is open to the second oil pressure chamber 28 while oil pressure applied to the first chamber 22 is relatively low. When the plunger 20 moves towards the piston 26 to decrease the volume of the second oil pressure chamber 28, a portion of the oil in the chamber 28 is discharged therefrom into the oil-reserving chamber 56 until the hole 58 is completely closed by the plunger 20. Accordingly the oil-reserving chamber 56 may be designed either as an accumulator or as a variable-volume chamber partly defined by a flexible diaphragm. In the illustrated embodiment, however, the oil-reserving chamber 56 takes the form of a variable-volume chamber defined in a cylindrical bore 60 in which a free piston 62 is slidably disposed. A compression spring 64 is installed in the bore 60 to bias the free piston 62 in a direction to decrease the volume of the oil-reserving chamber 56, and an oil passage 66 to introduce the engine lubricating oil into the second oil pressure chamber 28 passes through the free piston 62 with the provision of a check valve 68 to prevent reverse flow of the oil to the oil passage 66 when the oil is discharged from the second oil pressure chamber 28 to the oil-reserving chamber 56. In a case where the oil passage 66 is formed through the piston 26 (instead of passing through the free piston 62), the check valve 68 will be attached to the piston 26.

The operation of the mechanism of FIG. 1 will be described with reference to the chart of FIG. 4.

Figure 4:
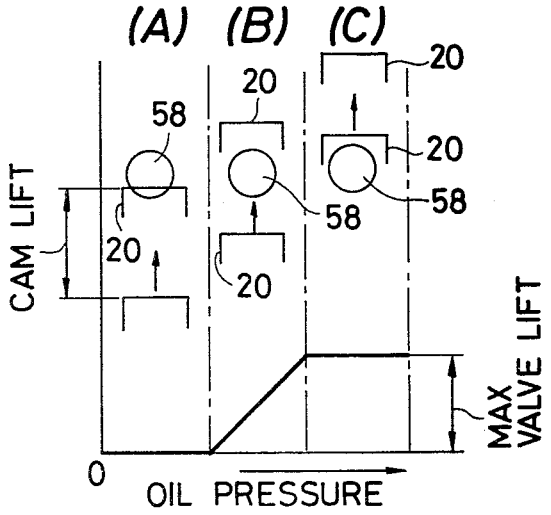
FIG. 4 is a chart showing the function of the mechanism of FIG. 1.

While the oil pressure applied to the first oil pressure chamber 22 is very low, i.e. in the range (A) of FIG. 4, the plunger 20 under the force of the spring 30 is so distant from the piston 26 that the hole 58 is fully open to the second oil pressure chamber 28. When the cylinder 18 in this state is moved towards the piston 26 by the lobe of the rotating cam 16, the plunger 20 moves together with the cylinder 18 since there occurs little change in the volume of the first oil pressure chamber 22. The movement of the plunger 20 tends to cause an increase in the oil pressure in the second chamber 28, but actually a portion of the oil in the second chamber 28 is discharged into the cylinder 60 through the hole 58 whereby the free piston 62 is moved in a direction to increase the volume of the oil-reserving chamber 56. As a consequence, there occurs little change in the oil pressure in the second chamber 28 (an expected increase in the oil pressure is absorbed by the movement of the free piston 62) so that the movement of the plunger 20 does not cause movement of the piston 26. Accordingly the push rod 14 does not move, either. This means that the intake or exhaust valve makes no lift even though the cam 16 is rotated insofar as the oil pressure applied to the first oil pressure chamber 22 is below a predetermined level.

In the range (B) of FIG. 4, oil pressure applied to the first chamber 22 is augmented such that the hole 58 is still at least partly open to the second oil pressure chamber 28 while the cylinder 18 takes a position remotest from the piston 26 but is closed gradually as the cylinder 18 is lifted together with the plunger 20 by the lobe of the cam 16. In this case the absorption of an increase in the oil pressure in the second chamber 28 by the free piston 62 ceases upon complete closing of the hole 58 by the lifted plunger 20, so that thereafter the push rod 14 is caused to move by the movement of the plunger 20 transmitted through the oil in the chamber 28. As shown in FIG. 4, the amount of the valve lift in the range (B) depends on the oil pressure applied to the first chamber 22. The closing of the hole 58 by the lifted plunger 20 does not occur abruptly but occurs gradually in compliance with the movement of the plunger 20. In a partly closed state the hole 58 offers a resistance to the outflow of the oil from the second oil pressure chamber 28, and the magnitude of the resistance augments as the closing of the hole 58 nears completion. Accordingly, an actual increase in the oil pressure in the second chamber 28 with a resultant movement of the push rod 14 begins before complete closing of the hole 58. The lift of the intake or exhaust valve through the function of the mechanism of FIG. 1, therefore, does not occur impulsively.

When oil pressure applied to the first chamber 22 is further augmented such that the hole 58 is completely closed by the plunger 20 even when the cylinder 18 remains at the position remotest from the piston 26, that is, when the oil pressure is in the range (C) of FIG. 4, the rotation of the cam 16 results in that the push rod 14 is moved in compliance with the movement of the cylinder 18 together with the plunger 20. In this oil pressure range (C) the mechanism in the bore 12 acts as if a tappet made of a single rigid member.

The advantage of a valve lifter mechanism according to the invention will be readily understood from a comparison of the above described embodiment with a conventional hydraulic valve lifter according to U.S. Pat. No. 4,020,806, shown in FIG. 5.

A hollow cylindrical body 70 of this valve lifter or tappet is slidably received in a bore 12A formed through the engine block 10. An end wall **70*a* of the body 70 keeps in contact with the lobed cam 16. A hollow plunger 72 is connected at its one end to a push rod cap 74, which supports the free end of the push rod 14, and slidably disposed in the body 70. An axial bore or chamber 76 in the plunger 72 communicates with an oil gallery 78 formed in the engine block 10 through a radial aperture 82 of the plunger 72 and a radial aperture 80 of the body 70, so that engine lubricating oil can be supplied to the chamber 76. An oil pressure chamber 84 is defined in the body 70 between the free end of the plunger 72 and the end wall 70*a*. A hole 77 provides communication between the chamber 76 in the plunger 70 and the oil pressure chamber 84 via a check valve 86. A free piston 88 disposed in the oil pressure chamber 84 partitions this chamber 84 from another chamber 90 which is located adjacent the end wall 70*a* and communicates with the atmosphere through a vent hole 92. A compression spring 94 is installed in the chamber 90 so as to bias the free piston 88 towards the plunger 72. In addition a compression spring 96 may be installed in the oil pressure chamber 84**.

At high engine speeds, oil pressure applied to the chamber 84 is high enough to keep the free piston 88 in the lowermost (in FIG. 5) position. In this state the lifter of FIG. 5 does not differ from an ordinary rigid tappet, so that there occurs no change in the amount of valve lift. As the engine speed lowers the force of the spring 94 overcomes a decreased oil pressure in the chamber 84, and accordingly the free piston 88 is moved towards the plunger 72 to decrease the volume of the chamber 84 until it minimizes during idling of the engine. When the body 70 is lifted by the cam lobe while the oil pressure chamber 84 has a considerably small volume, there occurs an abrupt increase in the oil pressure in this chamber 84 with the result that the free piston 88 is abruptly thrusted down to its lowermost position. Since this movement of the free piston 88 causes an abrupt decrease in the oil pressure in the chamber 84, the plunger 72 makes a rapid movement relative to the body 70 towards the free piston 88. As a consequence, the transmission of the movement of the body 70 to the push rod cap 74 is retarded and the amount of valve lift decreases.

Figure 5:
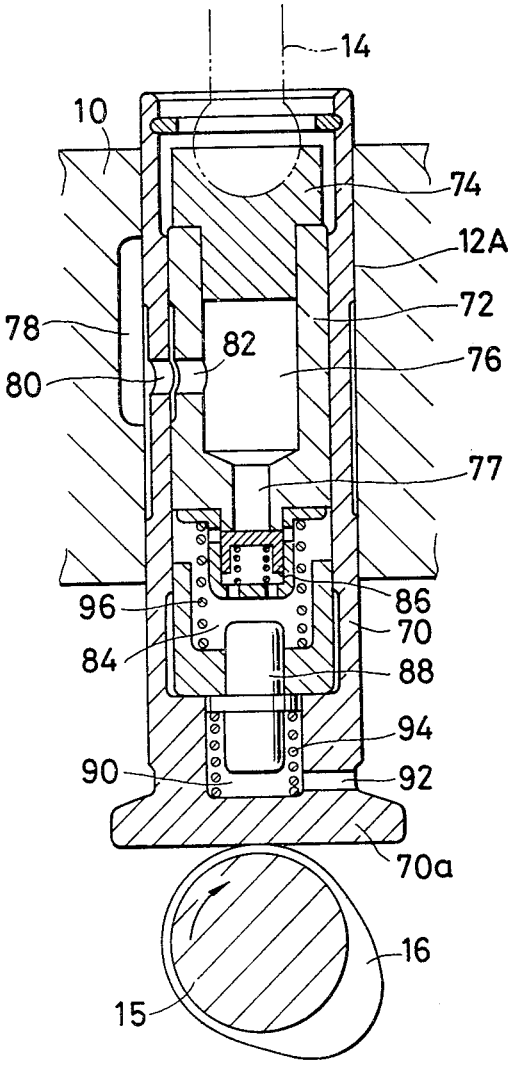
FIG. 5 PRIOR ART
FIG. 5 is a longitudinal sectional view of a conventional hydraulic valve lifter.

In contrast with such abrupt changes of the oil pressure in the valve lifter of FIG. 5, oil pressure in the second oil pressure chamber 28 of the lifter mechanism of FIG. 1 exhibits a gradual and smooth increase as the hole 58 is gradually closed by the moving plunger 20. Accordingly the valve action in the oil pressure range or engine speed range(B) of FIG. 4 occurs with minimized shock. Thus the invention has succeeded in dissolving the problem inherent to conventional hydrualic valve lifters of the type shown in FIG. 5. A valve lifter mechanism according to the invention makes it possible to smoothly vary the amount of valve lift depending on the engine speed without augmenting the noise of the valve train action. Besides, the lifter mechanism itself is good at durability and the use of this mechanism has little adverse influence on the durability of other components of the valve train.

What is claimed is:

1. In a valve train for an internal combustion engine, having a lobed cam mounted on a camshaft and a push rod linked with a valve to be intermittently opened according to the rotation of the cam, a hydraulic valve lifter mechanism comprising:

a hollow cylindrical body which has an open end and a closed end and is slidably received in a bore formed through an engine block such that said closed ends keeps sliding contact with said cam;

a piston connected to said push rod and slidably received in an end portion of said bore;

a plunger which is slidably received in said bore and in an end portion thereof slidably intrudes into said cylindrical body so as to define a first oil pressure chamber in a closed end portion of said body and a second oil pressure chamber in said bore between said plunger and said piston;

means for applying an oil pressure which is variable depending on the operating condition of the engine to said first oil pressure chamber; and an oil-reversing chamber formed in said engine block so as to communicate with said second oil pressure chamber through a hole which is open to said second oil pressure chamber while said oil pressure is relatively low so that said plunger is relatively distant from said piston but is closed by said plunger while said oil pressure is relatively high so that said plunger is moved relative to said body towards said piston, whereby the amount of lift of said valve depends on said oil pressure applied to said first oil pressure chamber and, in a medium range of said oil pressure, the amount of the valve lift varies depending on a resistance offered by said hole in a partly closed state to the outflow of oil from said second oil pressure chamber into said oil-reserving chamber while said body and said plunger are moved towards said piston by the rotating cam.

2. A valve lifter mechanism as claimed in claim 1, wherein said hole joins said bore at such a location relative to said piston and said plunger that said hole is completely closed by said plunger irrespective of the angular position of said cam while said oil pressure is above a predetermined level but is at least partly open to said second oil pressure chamber even when said body and said plunger are maximumly moved towards said piston by the rotating cam while said oil pressure is below said predetermined level.

3. A valve lifter mechanism as claimed in claim 1 or 2, wherein said means has the function of supplying engine lubricating oil delivered from a pump driven by the engine to said first oil pressure chamber and decreasing said oil pressure as the engine speed lowers, so that the amount of the valve lift is decreased as the engine speed lowers.

4. A valve lifter mechanism as claimed in claim 3, wherein said means comprises a valve means responsive to the action of means for controlling the rate of supply of an air-fuel mixture to the engine such that said oil pressure is decreased as said rate of supply of said air-fuel mixture is decreased.

5. A valve lifter mechanism as claimed in claim 1 or 2, wherein said means comprises a valve means for varying said oil pressure in response to changes in the magnitude of vacuum in an induction passage for the engine at a section upstream of a throttle valve such that said oil pressure decreases as the magnitude of said vacuum decreases.

6. A valve lifter mechanism as claimed in claim 1 or 2, wherein said means comprises a valve means for varying said oil pressure in response to changes in the magnitude of vacuum in an induction passage for the engine at a section downstream of a throttle valve such that said oil pressure decreases as the magnitude of said vacuum increases.

7. A valve lifter mechanism as claimed in claim 1 or 2, wherein said oil-reserving chamber is a variable-volume chamber defined in a cylindrical space in which a free piston is slidably received with the provision of a compression spring arranged to bias said free piston in a direction to decrease the volume of said oil-reserving chamber.

8. A valve lifter mechanism as claimed in claim 7, wherein said oil-reserving chamber communicates with with an oil supply passage through a bore formed in said free piston and comprises a check valve attached to said free piston so as to block said bore in said free piston when oil is discharged from said second oil pressure chamber into said oil-reserving chamber.

9. A valve lifter mechanism as claimed in claim 1 or 2, further comprising a spring disposed in said second oil pressure chamber so as to bias said plunger towards said first oil pressure chamber thereby to adjust the movement of said plunger caused by an increase in said oil pressure.

10. A valve lifter mechanism as claimed in claim 1 or 2, wherein said plunger is formed with a bore through which said oil pressure is applied to said first oil pressure chamber, the lifter mechanism further comprising a check valve attached to said plunger so as to block said bore in said plunger when said body is moved towards said piston by the rotating cam.

11. A valve lifter mechanism as claimed in claim 10, wherein said oil-reserving chamber is a variable-volume chamber defined in a cylindrical space in which a free piston is slidably received with the provision of a compression spring arranged to bias said free piston in a direction to decrease the volume of said oil-reserving chamber, said oil-reserving chamber communicating with an oil supply passage through a bore formed in said free piston and comprises a check valve attached to said free piston so as to block said bore in said free piston when oil is discharged from said second oil pressure chamber into said oil-reserving chamber, the mechanism further comprising a compression spring disposed in said second oil pressure chamber so as to bias said plunger towards said first oil pressure chamber thereby to adjust the movement of said plunger caused by an increase in said oil pressure.

* * * * *